US005136746A

United States Patent [19]

Jones

[11] Patent Number: 5,136,746

[45] Date of Patent: Aug. 11, 1992

[54] ADJUSTABLE SHOE HOLDER AND SUPPORT

[76] Inventor: Willard Jones, 211 North St., Natchitoches, La. 71457

[21] Appl. No.: 731,243

[22] Filed: Jul. 17, 1991

[51] Int. Cl.[5] ..... A43D 15/00

[52] U.S. Cl. ..... 12/124; 12/116.2

[58] Field of Search ..... 12/123, 124, 114.2, 12/116.6, 116.2, 117.4, 136 R

[56] References Cited

U.S. PATENT DOCUMENTS

| | | | |
|---|---|---|---|
| 219,753 | 9/1879 | Morrell | 12/124 |
| 279,169 | 6/1883 | Jones | 12/124 |
| 282,278 | 7/1883 | Dalby | 12/124 |
| 509,497 | 11/1893 | Sumner | 12/124 |
| 632,776 | 9/1899 | Brooks | 15/267 |
| 658,191 | 9/1900 | Robinson et al. | 12/124 |
| 830,632 | 9/1906 | Anderson | 12/116.2 X |
| 859,892 | 7/1907 | Rendle | 12/124 |
| 954,828 | 4/1910 | Sonntag | 12/116.2 X |
| 1,023,760 | 4/1912 | Rendle | 12/124 |
| 2,961,685 | 11/1960 | Aiken . | |
| 3,040,360 | 6/1962 | Friedman . | |
| 3,278,970 | 10/1966 | Bowles | 15/267 |
| 3,641,617 | 2/1972 | Lopez | 15/267 |
| 4,109,335 | 8/1978 | Randolph | 12/123 |
| 4,483,039 | 11/1984 | Breen | 12/123 X |
| 4,984,327 | 1/1991 | Braverman | 12/123 X |

FOREIGN PATENT DOCUMENTS

| | | | |
|---|---|---|---|
| 472403 | 3/1951 | Canada | 12/117.4 |
| 515848 | 12/1939 | United Kingdom | 12/114.2 |
| 1172282 | 11/1969 | United Kingdom . | |

*Primary Examiner*—Paul T. Sewell
*Assistant Examiner*—BethAnne C. Cicconi
*Attorney, Agent, or Firm*—Nikaido, Marmelstein, Murray & Oram

[57] ABSTRACT

A universal shoe holder having a detachable mounting member for securing the holder to a work surface, and a supporting member which supports the shoe holding mechanism perpendicular to the mounting member. The shoe holding mechanism consists of a holding member fastened to the support member, and a heel support member which is pivotally attached thereto. A tightening mechanism is provided which exerts pressure on the heel support member and the holding member, allowing the shoe holder to securely hold various styles and sizes of shoes during repair and polishing procedures. An adjusting mechanism is included to allow the shoe holder to be adjusted to fit different sizes of shoes.

4 Claims, 4 Drawing Sheets

ADJUSTABLE SHOE HOLDER AND SUPPORT

BACKGROUND OF THE INVENTION

1. Field of the Invention

The present invention is a universal shoe holder which is intended to rigidly support a variety of different size shoes during shoe shining and shoe repair operations. The holder is easily detachable from a work surface, to allow it to be put away when not in use.

2. Description of the Related Art

Many different shoe holders and shoe support apparatus are known in the prior art, which enable holding shoes during repair operations. Some limitations in these older devices are that they are bulky, expensive to manufacture, some of them are not adjustable for different types of shoes, and some do not adequately support shoes during repair or polishing procedures.

SUMMARY OF THE INVENTION

The universal shoe holder of the present invention is an efficient, easy to manufacture mechanism, which can be easily removed from the work surface during periods of non-use.

The shoe holder comprises mounting means for securing the holder to a work surface; a support member perpendicularly fastened to the mounting means; a holding member fixably fastened to the support member; a heel support member pivotally attached to the holding member; and tightening means for exerting pressure on the heel support member.

The tightening means includes a Z-shaped handle pivotally mounted on the heel support member; spring means pivotally mounted on the Z-shaped handle member; and adjusting means pivotally connected to the holding member and the Z-shaped handle member, for varying a distance between the holding member and the heel support member, wherein the holding member and the heel support member are springably separated through expansion force provided by the spring means, and a shoe is forcibly held by the holding member and the heel support member through pressure provided by the springable separation therebetween.

The spring means includes a slide guide located at a rotational connection point of the holding member and the heel support member; a slide bar pivotally mounted on the Z-shaped handle member, wherein the spring means is disposed on a periphery of the slide bar, and the slide bar is slidably disposed in the slide guide.

The adjusting means has a first rotational mounting point on the holding member; a second rotational mounting point on the Z-shaped handle member; an adjustable member having two ends, with one end mounted on the first rotational mounting point and the other end mounted on the second rotational mounting point, wherein a fixed distance between the two rotational mounting points can be adjusted by adjusting the adjustable member, which varies the distance between the holding member and the heel support member.

The device slides into the mounting means, which is a permanently mounted fixed member, and is held at a right angle to this fixed member by a mounting member and a supporting member. The holding member and the heel support member are provided with an end portion which fits inside of a shoe. The handle is provided as part of a tightening/loosening mechanism, whereby when the handle is pulled upward, the spring pressure on the heel support member and the holding member is removed, and the members can be drawn closer together. The size of the shoe determines the final distance between the heel support member and the holding member, and the shoe is held in place by the spring force between the two members. An adjusting mechanism is provided to adjust the maximum distance between the holding member and the heel support member for shoes that are unusually large or unusually small.

BRIEF DESCRIPTION OF THE DRAWINGS

The above and other objects and the attendant advantages of the present invention will become readily apparent by reference to the following detailed description when considered in conjunction with the accompanying drawings wherein.

DESCRIPTION OF THE PREFERRED EMBODIMENTS

Figure 1:
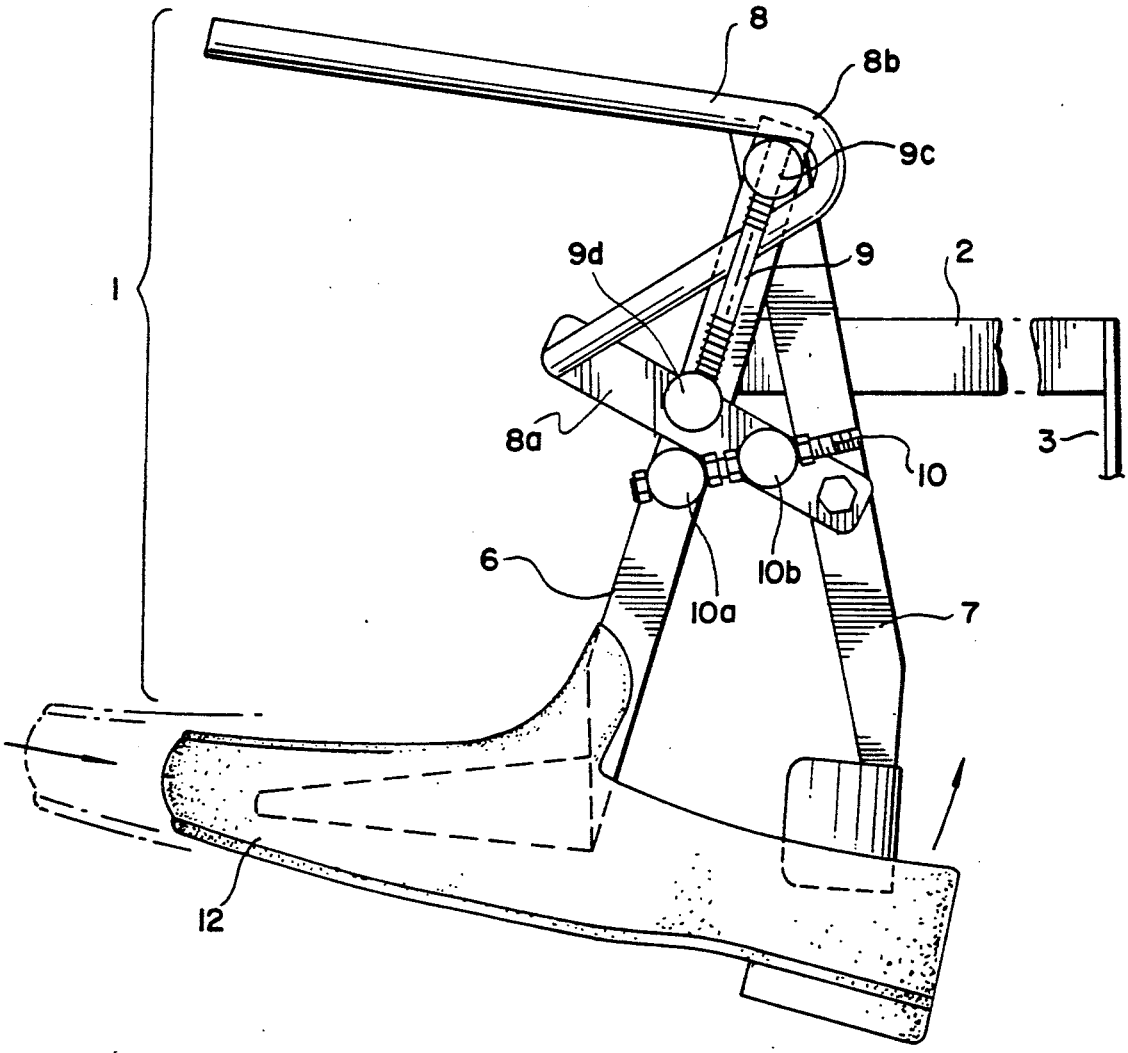
FIG. 1 is a left-side view of the invention, with a shoe being installed.
Figure 2:
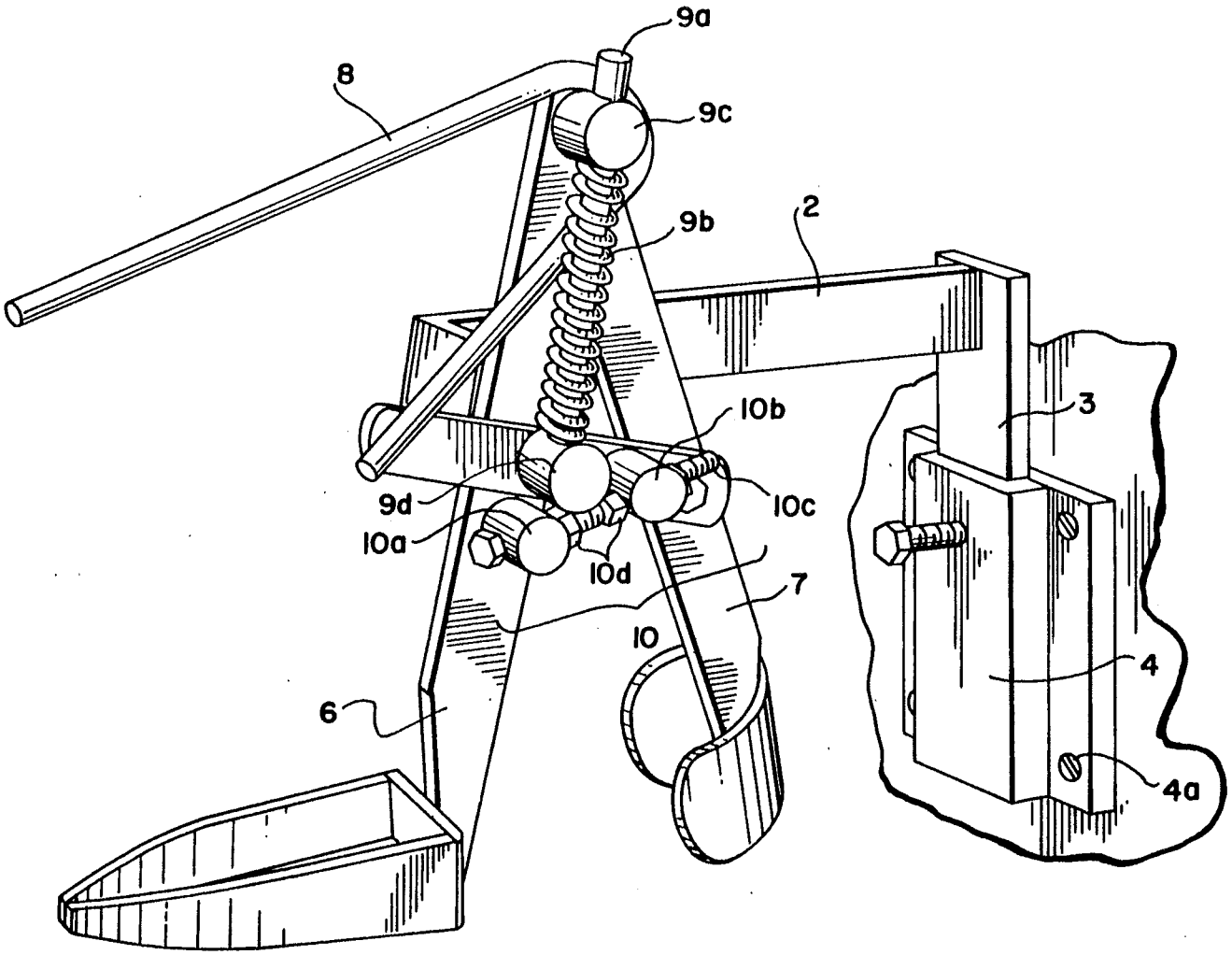
FIG. 2 is a perspective view of the invention.
Figure 3:
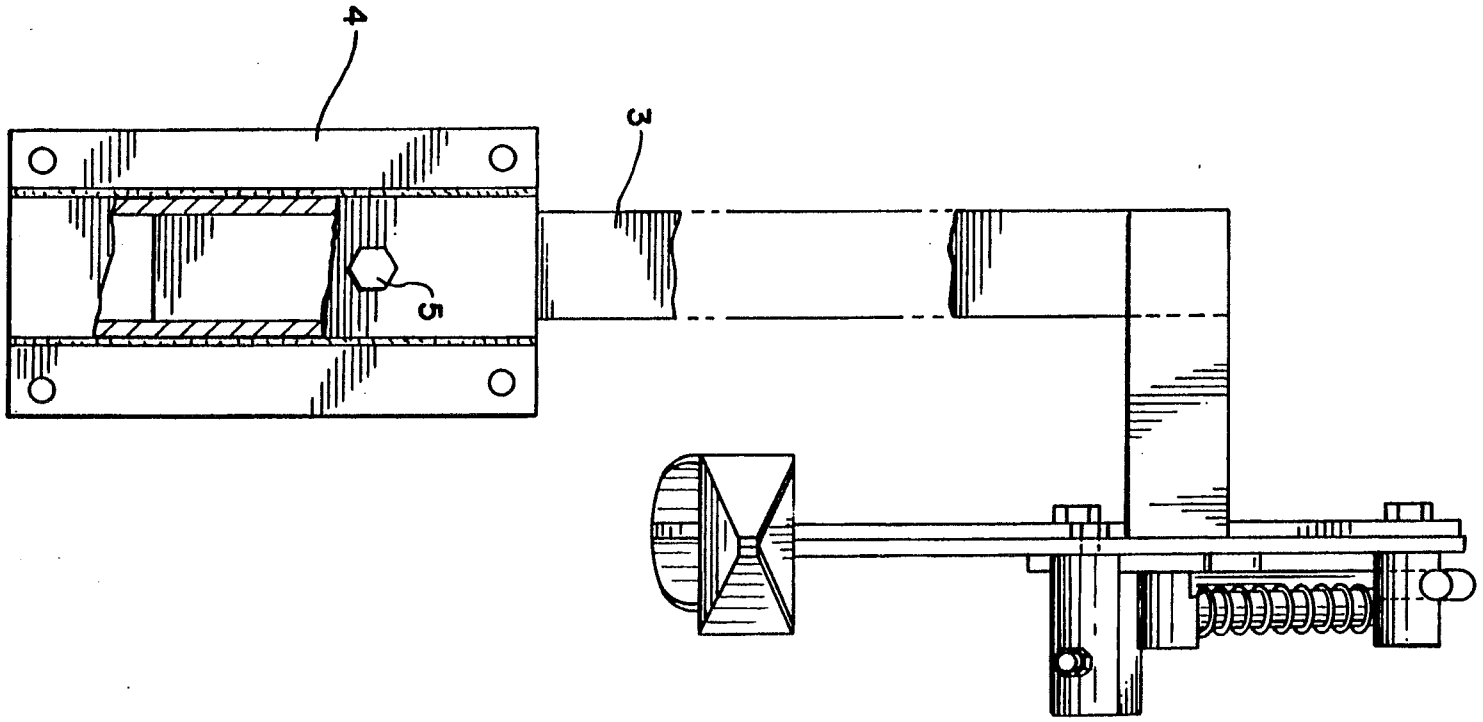
FIG. 3 is a head-on view of the invention, with a view of the mounting means.
Figure 4:
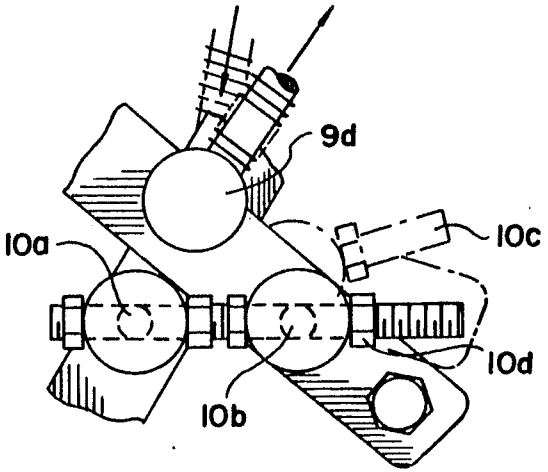
FIG. 4 is a close-up view of the adjusting mechanism of the invention.
Figure 5:
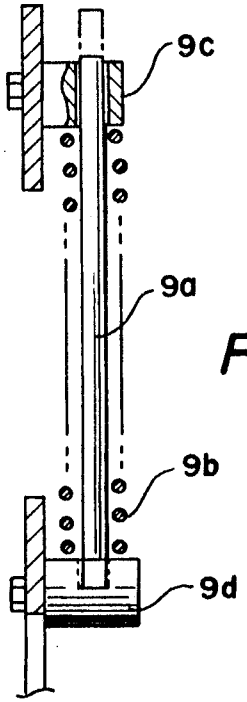
FIG. 5 is a close-up view of the spring mechanism of the invention.
Figure 6:
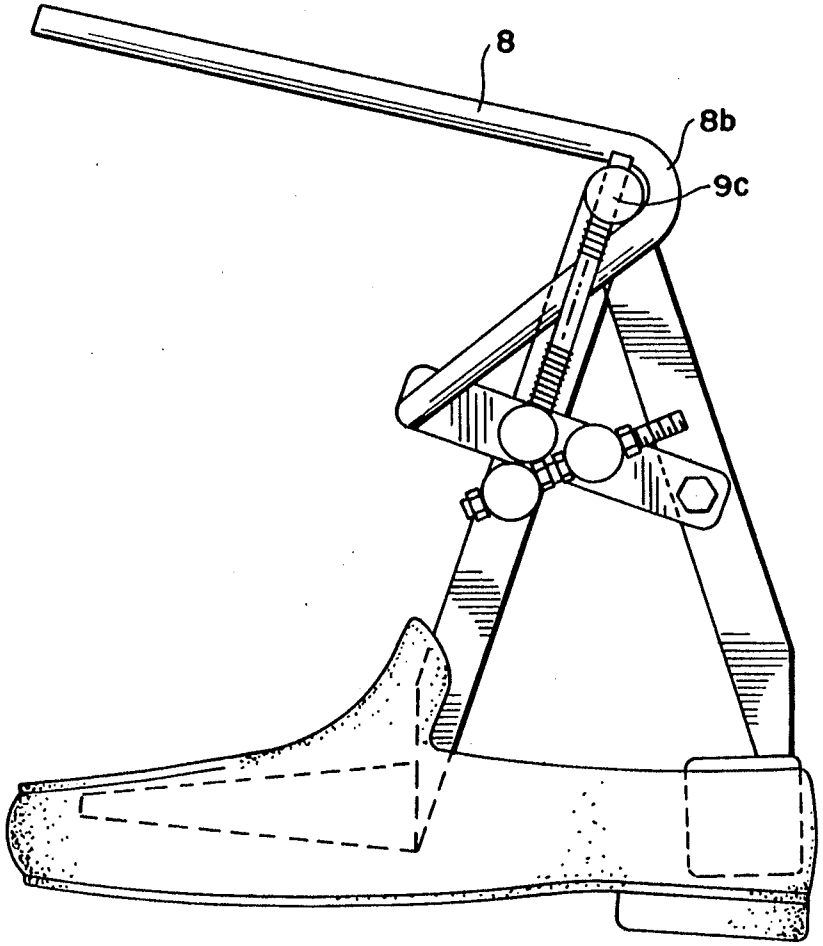
FIG. 6 illustrates the invention in use, with the mounting member and support member omitted for clarity.

FIGS. 1–6 illustrate various views of a universal shoe holder according to the present invention, wherein holder 1 is intended to rigidly support a variety of different sized shoes during shining and repair operations. Holder 1 is supported by support member 2, which is secured to a work surface by mounting member 3. Mounting member 3 slides into a fixed member 4, and can be securely held in place by tightening nut 5. Fixed member 4 can be secured to a work surface by fasteners 4*a*. Holder 1 and the associated mounting and support means can be constructed of metal, fiberglass, or similar suitable material.

Holder 1 is made up of holding member 6 which is securely fastened to support member 2, and heel support member 7 which is pivotally mounted to the upper end of holding member 6. Z-shaped handle member 8 is pivotally mounted at one end to the middle section of heel support member 7. Spring mechanism 9 is pivotally mounted at one end onto bottom arm 8*a* of handle member 8, at pivot 9*d*. Spring mechanism 9 consists of sliding member 9*a*, which is pivotally mounted to bottom member 8*a* as mentioned earlier, and slidably mounted at the other end onto pivot 9*c*, which is pivotally mounted to the rotational connection point of holding member 6 and heel support member 7. Spring 9*b* is fitted over sliding member 9*a*, and provides spring tension between pivot 9*c* and pivot 9*d* which is part of the rotational mounting to bottom arm 8*a* of handle 8.

Adjusting means 10 is mounted to the middle section of holding member 6 at pivot 10*a*, and to bottom portion 8*a* of handle 8 at pivot 10*b*. Threaded rod 10*c* slides through bores which are provided through each pivot 10*a* and 10*b*. Nuts 10*d* are provided onto threaded rod 10*c*, and can be used to manually adjust a distance between holding member 6 and bottom portion 8*a*. Through the operation of handle member 8*a* as discussed below, this adjusting mechanism can vary the distance between holding member 6 and heel support member 7; therefore, accommodating a variety of shoe sizes.

The operation of the universal shoe holder of the present invention will now be discussed in detail. A workpiece such as shoe 12 can be slid rearward onto holding member 6, and then pulled upward toward heel support member 7. Pulling upward on Z-shaped handle member 8 will move heel support member 7 toward holding member 6, and allow shoe 12 to be slid onto heel support member 7. Pressure from expansion of spring **9*b* pushes heel support member 7 rearward toward the back of shoe 12 through the action of spring mechanism 9, upon the release of Z-shaped handle member 8. Spring mechanism 9 puts constant downward pressure onto the lower portion 8*a* of handle member 8, which results in a rearward pushing force on heel support member 7. Therefore, a rearward force is constantly applied to heel support member 7 by lower portion 8*a*. This rearward force will push heel support 7 out to a physical limit controlled by adjusting mechanism 10; adjusting nuts 10*d* on threaded rod 10*c* can be manipulated to expand or contract this physical limit. By rotating adjusting nuts 10*d* so that pivots 10*a* and 10*b* are close together, the universal holder is then adjusted to fit a variety of smaller sized shoes. By rotating adjusting nuts 10*d* to move pivots 10*a* and 10*b*** farther apart, the universal shoe holder will accommodate shoes of larger sizes.

Pulling up on Z-shaped handle member 8 will release the rearward pressure on heel support member 7, thereby allowing easy removal or replacement of shoes from shining or repair operations.

It is readily apparent that the above-described invention has the advantages of wide commercial utility. It should be understood that the specific form of the invention hereinabove-described is intended to be representative only, and certain modification within the scope of these teachings will be apparent to those skilled in the art.

Accordingly, reference should be made to the following claims in determining the full scope of the invention.

What is claimed is:

1. A universal shoe holder, comprising:

mounting means for securing the holder to a work surface;

a support member perpendicularly fastened to said mounting means;

a holding member fixably fastened to said support member;

a heel support member pivotally attached to said holding member; and tightening means for exerting pressure on said heel support member, said tightening means comprising:

a Z-shaped handle member pivotally mounted on said heel support member;

spring means pivotally mounted on said Z-shaped handle member; and adjusting means pivotally connected to said holding member and said Z-shaped handle member, for varying a distance between said holding member and said heel support member, wherein said holding member and said heel support member are springably separated through expansion force provided by said spring means, and a shoe is forcibly held by said holding member and said heel support member through pressure provided by the springable separation therebetween.

2. A universal shoe holder according to claim 1, wherein said spring means further includes:

a slide guide located at a rotational connection point of said holding member and said heel support member;

a slide bar pivotally mounted on said Z-shaped handle member, wherein said spring means is disposed on a periphery of said slide bar, and said slide bar is slidably disposed in said slide guide.

3. A universal shoe holder according to claim 1 wherein said adjusting means comprises:

a first rotational mounting point on said holding member;

a second rotational mounting point on said Z-shaped handle member;

an adjustable member having two ends, with one end mounted on said first rotational mounting point and the other end mounted on said second rotational mounting point, wherein a fixed distance between the two rotational mounting points can be adjusted by adjusting said adjustable member, which varies the distance between said holding member and said heel support member.

4. A universal shoe holder according to claim 1, wherein said mounting means comprises:

a fixed member firmly mounted to a work surface, said fixed member having a cavity located therein, a mounting member perpendicularly fastened to said support member, said mounting member having a cross section which matches a cross-section of the cavity in said fixed member, wherein said mounting member mounts to said fixed member by being slidably fitted into said cavity providing a sturdy, detachable mounting of the universal shoe holder to the work surface.

* * * * *